US008611569B2

(12) United States Patent
Cornelisse et al.

(10) Patent No.: US 8,611,569 B2
(45) Date of Patent: Dec. 17, 2013

(54) HEARING SYSTEM WITH A USER PREFERENCE CONTROL AND METHOD FOR OPERATING A HEARING SYSTEM

(75) Inventors: Leonard Cornelisse, Waterloo (CA); Henry Luo, Waterloo (CA); Ara Talaslian, Cambridge (CA); Robert Walesa, Wellesley (CA); Donald Hayes, Stratford (CA)

(73) Assignee: Phonak AG, Stafa (CH)

( * ) Notice: Subject to any disclaimer, the term of this patent is extended or adjusted under 35 U.S.C. 154(b) by 353 days.

(21) Appl. No.: 12/679,505

(22) PCT Filed: Sep. 26, 2007

(86) PCT No.: PCT/EP2007/060240

§ 371 (c)(1),
(2), (4) Date: Mar. 23, 2010

(87) PCT Pub. No.: WO2009/039885

PCT Pub. Date: Apr. 2, 2009

(65) Prior Publication Data

US 2010/0202637 A1 Aug. 12, 2010

(51) Int. Cl.
*H04R 25/00* (2006.01)

(52) U.S. Cl.
USPC ..... 381/314; 381/312

(58) Field of Classification Search
USPC ..... 381/312–331
See application file for complete search history.

(56) References Cited

U.S. PATENT DOCUMENTS

2002/0076072 A1 6/2002 Cornelisse
2003/0091197 A1 * 5/2003 Roeck et al. ..... 381/60
2004/0131195 A1 * 7/2004 Mergell ..... 381/60
2004/0190738 A1 9/2004 Meier et al.
2004/0190739 A1 * 9/2004 Bachler et al. ..... 381/314
2004/0208331 A1 10/2004 Chalupper
2005/0129262 A1 6/2005 Dillon et al.
2007/0076909 A1 * 4/2007 Roeck et al. ..... 381/312

FOREIGN PATENT DOCUMENTS

EP 1708543 A1 10/2006
WO 0057672 A2 9/2000

OTHER PUBLICATIONS

International Search Report for PCT/EP2007/060240 dated Jun. 27, 2008.
Written Opinion for PCT/EP2007/060240 dated Jun. 27, 2008.

* cited by examiner

*Primary Examiner* — Duc Nguyen
*Assistant Examiner* — Matthew Eason
(74) *Attorney, Agent, or Firm* — Pearne & Gordon LLP

(57) ABSTRACT

A hearing system that includes a user control and a signal processing unit controllable by adjustable parameters can be adjusted to preferences of a user. Such an adjustment can involve providing a first set of start-up parameter settings upon start-up of said signal processor unit, using parameter settings included in or derived from said first set of start-up parameter settings as default parameter settings for said signal processing unit, obtaining a set of parameter settings currently used in said signal processing unit upon operating said user control, deriving a second set of start-up parameter settings in dependence of said first set of start-up parameter settings and of said set of parameter settings obtained, and using said second set of start-up parameter settings as said first set of start-up parameter settings when providing said first set of start-up parameter settings upon a following start-up of said signal processor unit.

15 Claims, 2 Drawing Sheets

HEARING SYSTEM WITH A USER PREFERENCE CONTROL AND METHOD FOR OPERATING A HEARING SYSTEM

TECHNICAL FIELD

The invention relates to a hearing system and to a method for operating a hearing system. The invention relates to methods and apparatuses according to the opening clauses of the claims. In particular, the invention relates to the adjustment of hearing systems or hearing devices to the preferences of a user, also referred to as "fitting".

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

A hearing system comprises at least one hearing device. In case that a hearing system comprises at least one additional device, all devices of the hearing system are operationally connectable within the hearing system. Typically, said additional devices such as another hearing device, a remote control or a remote microphone, are meant to be worn or carried by said individual.

Under audio signals we understand electrical signals, analogue and/or digital, which represent sound.

BACKGROUND OF THE INVENTION

From US 2004/0208331 A1, a hearing device is known, which is adjustable by a user of the hearing device in the following manner: The user sets the amplification of the hearing device when he is located in a specific acoustic situation. In the event that this acoustic situation is characteristic for him, he initiates an adjustment event of his hearing device. This ensues either manually, or temporally controlled in known time intervals, or automatically in another manner. If the adjustment event is initiated, the current environment situation is acoustically measured. The acquired measurement values and the manually selected amplification values are drawn upon in order to determine a new characteristic line field, wherein a plurality of environment situations with corresponding amplifications is associated in this characteristic line field. If the hearing device user is now in a new acoustic environment situation, this is measured using characteristic sound quantities. With the aid of the newly determined characteristic line field, the hearing device automatically calculates a new amplification matching this new environment situation. With the aid of such a hearing-device-user-specific characteristic line field, the hearing device is expected to automatically adjust to the respective acoustic situations as the hearing device user would have manually done it himself. The setting value of the hearing device is thereby not only the amplification selected in the example, but rather if necessary also the compression or other characteristics.

In WO 00/57672 A2, a hand-held programmer for programming treatment appliances which are used for correcting a hearing aid is disclosed. The hearing aid user can enter in the programmer new settings for hearing aid related parameters and, upon giving a "saving" command, transmit the new parameter settings to the hearing aid, in which they are then stored and used.

In US 2005/0129262 A1, a programmable auditory prosthesis is presented, which adjusts its sound processing characteristics in a particular acoustic environment in a manner that is similar or identical to that previously determined by the user of the prosthesis as optimal for that environment. Each time a certain switch is actuated, the gain in each frequency band is logged along with a data set indicative of the acoustic environment detected by a microphone of the auditory prosthesis. By actuating that certain switch, the user can select which setting of a control means is the optimal one for the particular acoustic environment that they are in. A data processing unit of the auditory prosthesis can calculate general relationships between the amplification characteristics and the measured aspects of the acoustic environment from such logged data. The data processing unit does not calculate optimal gain equation coefficients until a predetermined number of selections have been made by the user. As long as that predetermined number of selections has not been made yet, the sound processor will output a signal calculated on the basis of initial, pre-defined values of trainable coefficients, wherein these initial, pre-defined values are calculated for each user by conventional methods of prescribing prosthesis operation, or by an empirical, trial and error adjustment process. Once the predetermined number of selections have been made, the data processing unit re-calculates the trainable coefficients immediately after every occasion on which the user operates that certain switch to indicate that the control means is in the optimal position.

In US 2004/0190738 A1, a method for adapting a hearing device to a momentary acoustic surround situation is disclosed.

In EP 1 708 543 A1, a hearing aid logging data and learning from these data is disclosed.

It is desirable to provide an alternative way of operating, in particular fitting, a hearing device or hearing system, and a corresponding hearing system.

SUMMARY OF THE INVENTION

One object of the invention is to create an alternative way of operating a hearing system. In addition, a respective hearing system and a respective computer program product shall be provided.

Another object of the invention is to provide a possiblity that allows a hearing system user to adjust his hearing system to his hearing preferences.

Another object of the invention is to provide a possiblity that allows to adjust a hearing system in an improved manner and/or in a particularly safe/robust manner.

Another object of the invention is to provide a possiblity that allows a hearing system user to adjust his hearing system to his hearing preferences in a way that can be easily handled by the user and/or which is pleasant for the user.

Further objects emerge from the description and embodiments below.

At least one of these objects is at least partially achieved by methods, systems and computer program products according to the patent claims.

The method for operating a hearing system comprising a user control referred to below as user preference control and a signal processing unit controllable by adjustable parameters comprises the steps of a) providing a first set of start-up parameter settings upon start-up of said signal processor unit;

b) using parameter settings comprised in or derived from said first set of start-up parameter settings as default parameter settings for said signal processing unit;

d) upon operating said user preference control: obtaining a set of parameter settings currently used in said signal processing unit;

e) deriving a second set of start-up parameter settings in dependence of said first set of start-up parameter settings and of said set of currently used parameter settings obtained in step d);

f) using said second set of start-up parameter settings as said first set of start-up parameter settings when carrying out step a) upon a following start-up of said signal processor unit.

The hearing system comprises a user control referred to below as user preference control;

a signal processing unit controllable by adjustable parameters;

a storage unit operationally connected to said signal processing unit, comprising a first set of start-up parameter settings;

a control unit operationally connected to said user preference control, to said signal processing unit and to said storage unit;

wherein said control unit is adapted to upon start-up of said signal processing unit: implementing in said signal processing unit said first set of start-up parameter settings, so that parameter settings comprised in or derived from said first set of start-up parameter settings are used as default parameter settings for signal processing in said signal processing unit;

upon operating said user preference control: obtaining a set of parameter settings currently used in said signal processing unit;

deriving a second set of start-up parameter settings in dependence of said first set of start-up parameter settings and of said obtained set of currently used parameter settings; and replacing in said storage unit said first set of start-up parameter settings by said second set of start-up parameter settings.

The computer program product comprises program code for causing a computer to perform the steps of A) providing a first set of start-up parameter settings upon start-up of a signal processor unit of a hearing system;

B) using parameter settings comprised in or derived from said first set of start-up parameter settings as default parameter settings for said signal processing unit;

G) receiving a user input from a user control of said hearing system referred to below as user preference control;

D) upon step G): obtaining a set of parameter settings currently used in said signal processing unit;

E) deriving a second set of start-up parameter settings in dependence of said first set of start-up parameter settings and of said set of currently used parameter settings obtained in step D);

F) using said second set of start-up parameter settings as said first set of start-up parameter settings when carrying out step A) upon a following start-up of said signal processor unit.

Through this, an improved fitting of a hearing system to the hearing preferences of a user of the hearing system can be achieved.

Said parameters are usually audio processing parameters.

Typically, at least a portion of said parameters is adjustable by a user of said hearing system.

Said user preference control can be, e.g., a switch or a button or a set of those, to be operated (pressed, turned, toggled . . . ) by the hearing system user. It can be arranged on any device of the hearing system, e.g., on a remote control or on a hearing device.

It is possible to provide that said providing or implementing said first set of start-up parameter settings takes places solely upon a start-up of said signal processing unit.

In one embodiment of the method, the parameters for which said set of parameter settings mentioned in step d) are obtained are adjustable by a user of said hearing system. Note that in this case, all parameters for which said set of currently used parameter settings is obtained are adjustable by the user; this, of course, does not exclude that, in addition, further parameter settings currently used in the signal processing unit exist and are obtained, which are possibly not adjustable by the user.

Typically, there is at least one user control such as a button, switch, wheel, provided in the hearing system allowing the user to adjust the adjustable parameters.

Some time after step a) and before step d), the user will typically carry out at least one adjustment of at least one of said adjustable parameters. Said parameters currently used in said signal processing unit (cf. step d)) are the default parameter settings mentioned in step b), changed by said adjustments carried out by the user.

In one embodiment, in step b), said parameter settings comprised in or derived from said first set of start-up parameter settings are used as default parameter settings for said signal processing unit until the next shut-down of said signal processor unit. This ensures that, from one start-up of said signal processing unit to a subsequent start-up of said signal processing unit, the default parameter settings change at a usually relatively slow pace and that the user will usually not even consciously perceive that changes in default parameter settings take place. This will usually provide that the hearing system user is not annoyed by his hearing system due to strongly changing audio processing parameters, and the fitting that takes place is—if at all—perceived in a pleasant, unobstrusive way.

In one embodiment, said second set of start-up parameter settings is used as said first set of start-up parameter settings not before another start-up of said signal processor unit occurred. This ensures that, from one start-up of said signal processing unit to a subsequent start-up of said signal processing unit, the default parameter settings change at a usually relatively slow pace and that the user will usually not even consciously perceive that changes in default parameter settings take place. This will usually provide that the hearing system user is not annoyed by his hearing system due to strongly changing audio processing parameters, and the fitting that takes place is —if at all—perceived in a pleasant, unobstrusive way.

In one embodiment, step e) is carried out in such a way that a gradual evolvement of said second set of start-up parameter settings from said first set of start-up parameter settings towards parameter settings in accordance with said currently used parameter settings occurs. This ensures that, from one start-up of said signal processing unit to a subsequent start-up of said signal processing unit, the default parameter settings change at a usually relatively slow pace and that the user will usually not even consciously perceive that changes in default parameter settings take place. This will usually provide that the hearing system user is not annoyed by his hearing system due to strongly changing audio processing parameters, and the fitting that takes place is—if at all—perceived in a pleasant, unobstrusive way.

Such a gradual evolvement can be accomplished, e.g., by using weighting factors in step e).

In one embodiment, the method comprises the step of c) deriving data characterizing a current acoustic environment;

wherein said deriving said second set of start-up parameter settings mentioned in step e) is carried out also in dependence of said data derived in step c).

This allows to derive different preferred settings for different acoustic environments.

Said current acoustic environment is usually the acoustic environment in which the hearing system is located.

In one embodiment, step c) comprises deriving a set of N class similarity factors, with N≥2, wherein each of said class similarity factors is indicative of the similarity of said current acoustic environment with a predetermined acoustic environment described by a respective class of N classes each of which describes a predetermined acoustic environment.

Such class similarity factors are known in what is referred to as "classification" in the art of hearing devices.

Said classes are usually predetermined classes.

In one embodiment, each of said first and second sets of start-up parameter settings comprises for each of said N classes a subset of start-up parameter settings associated with the respective class.

It is possible that an analysis of the current acoustic environment (such as a classification) is carried out (quasi-)continuously. Accordingly, it is possible to use the most recent data characterizing the current acoustic environment when carrying out step e). It is also possible to carry out step c) upon said operating said user preference control.

In one embodiment, in dependence of the class similarity factor associated with a respective class, parameter settings comprised in a subset of said first start-up parameter settings associated with said respective class or parameter settings derived therefrom are used or are not used or are used to a degree depending on the respective class similarity factor as default parameter settings for said signal processing unit.

Accordingly, different sound processing properties can be provided for different acoustic environments. It is possible, e.g., to use—in a current acoustic environment—that one subset of the first start-up parameter settings as default parameter settings, which is associated with that one class which has the greatest similarity to the current acoustic environment. It is also possible to use parameter settings as default parameter settings, which are obtained as a mixture of subsets of the first start-up parameter settings, wherein the contribution of each of the subsets depends on the class similarity factor of the corresponding class.

In one embodiment, in step e), parameter settings in subsets of start-up parameter settings of said second set of start-up parameter settings are changed (with respect to corresponding settings in said first set of start-up parameter settings) to an amount, which depends on the respective class similarity factor (as determined in step c)) of the class associated the respective subset. This enables an environment-dependent "learning" of improved parameter settings.

In one embodiment, in step e), parameter settings are left unchanged (with respect to corresponding settings in said first set of start-up parameter settings) in such subsets of start-up parameter settings of said second set of start-up parameter settings, which are associated with a class for which the respective class similarity factor (as determined in step c)) does not fulfill a pre-defined criterion. Such a criterion (or condition) can be, e.g., that the respective class similarity factor has to exceed a pre-defined threshold value.

In one embodiment, in step e), parameter settings are changed (with respect to corresponding settings in said first set of start-up parameter settings) at most in such subsets of start-up parameter settings of said second set of start-up parameter settings, which are associated with a class for which the respective class similarity factor as determined in step c) fulfills a pre-defined criterion. Such a criterion (or condition) can be, e.g., that the respective class similarity factor has to exceed a pre-defined threshold value.

In other words, similarity values are evaluated, and in dependence thereof, it is decided, whether or not and/or to which amount current parameter settings will influence the second set of start-up parameter settings.

In one embodiment, the hearing system comprises at least one user control by means of which a user of said hearing system can adjust those parameters for which said set of currently used parameter settings is obtained. Note that in this case, all parameters for which said set of currently used parameter settings is obtained are adjustable by the user; this, of course, does not exclude that, in addition, further parameter settings currently used in the signal processing unit exist and are obtained, which are possibly not adjustable by the user.

In one embodiment, the hearing system comprises an analyzing unit for deriving data characterizing a current acoustic environment, wherein said deriving said second set of start-up parameter settings is carried out also in dependence of said data.

In one embodiment, said analyzing unit is adapted to deriving a set of N class similarity factors, with N≥2, wherein each of said class similarity factors is indicative of the similarity of said current acoustic environment with a predetermined acoustic environment described by a respective class of N classes each of which describes a predetermined acoustic environment.

In one embodiment, each of said first and second sets of start-up parameter settings comprises for each of said N classes a subset of start-up parameter settings associated with the respective class.

In one embodiment, said control unit is adapted to providing that, in dependence of the class similarity factor associated with a respective class, parameter settings comprised in a subset of said first start-up parameter settings associated with said respective class or parameter settings derived therefrom are used or are not used or are used to a degree depending on the respective class similarity factor as default parameter settings for said signal processing unit.

In one embodiment, said control unit is adapted to providing that, in said deriving said second set of start-up parameter settings, parameter settings are left unchanged in such subsets of start-up parameter settings of said second set of start-up parameter settings, which are associated with a class for which the respective class similarity factor does not fulfill a pre-defined criterion.

In one embodiment, the hearing system is a hearing device, in particular a hearing-aid device.

In one embodiment, the hearing system is a hearing-aid system, i.e. a hearing system comprising at least one hearing-aid device.

The invention comprises hearing systems and computer program products, which correspond to methods according to the invention.

The advantages of the hearing systems and computer program products correspond to the advantages of corresponding methods.

Further embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
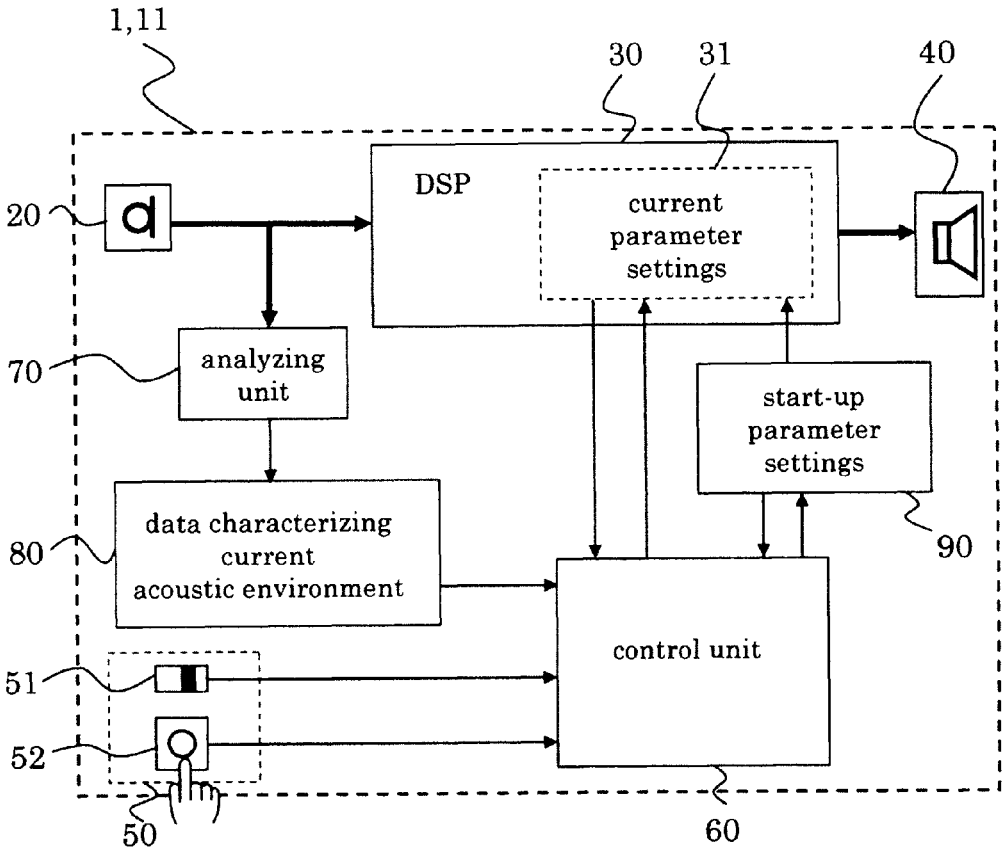
FIG. 1 a block-diagrammatical illustration of a hearing system with a user preference control.

FIG. 1 shows a block-diagrammatical illustration of a hearing system 1, which can be, as indicated, identical with a hearing device 11. The hearing system 1 comprises an input unit 20 such as a microphone for converting sound into audio signals, a signal processing unit 30 such as a digital signal processor for carrying out audio signal processing and an output unit 40 such as a loudspeaker for converting audio signals into signals to be perceived by a user of hearing system 1, typically sound waves. These are components comprised in practically every hearing device.

The audio processing carried out in signal processing unit 30 can be controlled by adjustable parameters 31, which allows to adjust the hearing system to the needs and preferences of said user. Accordingly, there are parameter settings stored in a storage unit 31, which are currently used in the audio processing in signal processing unit 30.

The hearing system 1 furthermore comprises a user interface 50, a control unit 60, an analyzing unit 70 and storage units 80 and 90. User interface 50 comprises user controls 51 and 52 which can be used by the user to adjust the audio processing properties of the hearing system 1 to his preferences. User control 51 can, e.g., be a digital volume control or the like, wherein there may be several such controls; whereas user control 52 is of particular importance for the invention. It can be a separate, dedicated user control, which will sometimes be referred to as user preference control below.

The function of the hearing system 1 of FIG. 1 will be described in conjunction with FIG. 3, in which a block diagram of a method for operating a hearing system such as the one of FIG. 1 is shown.

Upon start-up of the signal processing unit 30, which in many cases will be identical to the start-up of the hearing device 11 and/or to the start-up of the hearing system 1 (step 100), start-up parameter settings from storage unit 90 will be loaded into storage unit 31. This set of (start-up) parameter settings or parameter settings derived therefrom will be used as (initial) current parameter settings and more particularly as default parameter settings (step 110). This can, e.g., be accomplished by control unit 60 or directly.

When an analysis of the current acoustic environment is enabled, the current acoustic environment will be analyzed by analysis unit 70, based on audio signals generated by input unit 20 or on audio signals derived therefrom. The analysis will result in data characterizing a current acoustic environment (cf. storage unit 70). Said current acoustic environment is usually the acoustic environment in which the hearing system is located.

A well-known way of doing such an analysis is referred to as "classification", in which case analysis unit 70 is a classifier. For being able to describe the invention more concretely, we shall assume that analysis unit 70 is a classifier and that a classification is carried out in step 120. In a classification, properties of the above-mentioned audio signals are analyzed and compared to corresponding properties of several (typically 3 to 8) classes of predetermined acoustic environments such as for example "clean speech", "speech in noise", "music". For each class, a class similarity factor can be derived, which is indicative of the similarity (likeness) between the current acoustic environment and the acoustic environment described by the respective class. For example, a class similarity factor can be the higher the closer the current acoustic environment resembles the acoustic environment described by the respective class, and the class similarity factors can be normalized, e.g., such that the sum of all class similarity factors is 1 (one). It is, of course, also possible to work with other data characterizing a current acoustic environment.

In storage unit 90, there is one subset of start-up parameter settings per class. The parameter settings 31 to be currently used in a given acoustic environment will be derived from these subsets in dependence of the corresponding class similarity factors (step 130). In a simple implementation, one could simply take that one subset, the corresponding class similarity factor of which is the largest. In a more advanced implementation, the parameters of different subsets can be mixed in dependence of the corresponding class similarity factors in order to derive parameter settings 31 to be used in the current acoustic environment. Such implementations are known in the art.

Probably, sooner or later, the user will not be fully content with the way he perceives sound, i.e. he will find that the currently used parameter settings are not optimal for him (in the current acoustic environment he is in). In that case, the user will try to adjust his hearing system 1 to his preferences (step 140), by means of user controls such as user control 51. E.g., he will reduce the output volume if the signals he perceives are too loud, or he will decrease the high frequency components if he perceives the output signals as too sharp, or the like. This is achieved such that operating user control 51 will lead to the transmission of a corresponding signal to control unit 60, which thereupon will lead to a corresponding adjustment of at least one parameter of signal processing unit 30, i.e. the current parameter settings stored in storage unit 31 are changed as requested by the user. This can be accomplished by, e.g., adding or adjusting an offset to the default parameter settings derived from storage unit 90.

Current parameter settings can be stored and dealt with as relative values or as absolute values (here, "absolute value" does not mean the mathematical function which always renders a non-negative result). As relative values, the current parameter settings amount to the changes the user requested via user control 51, which corresponds to the difference between the absolute current parameter setting and the default parameter settings derived from the default parameter settings.

Figure 3:
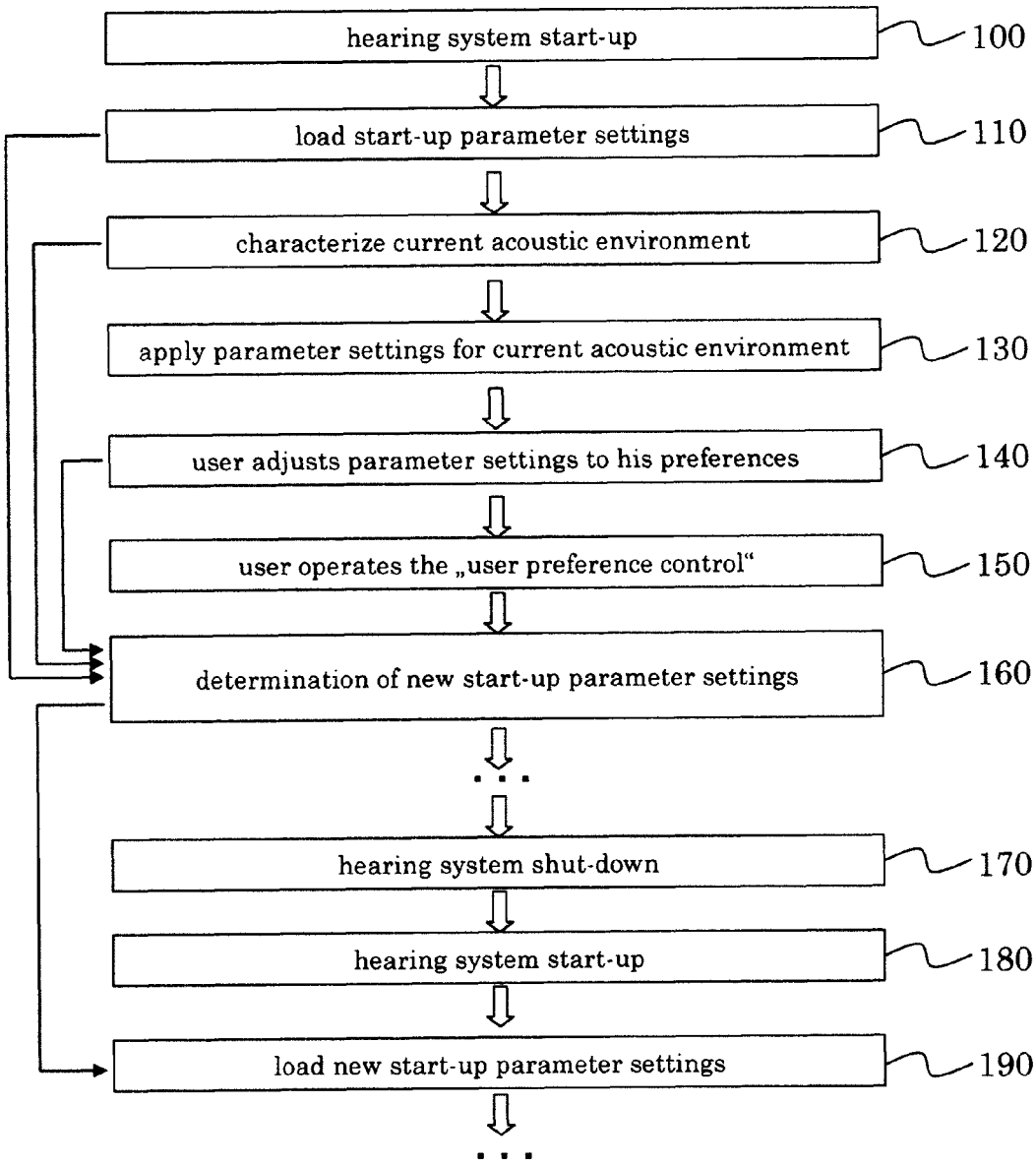
FIG. 3 a block diagram of a method for operating a hearing system.

The user may or may not move into other acoustic environments and carry out further adjustments, both not explicitely shown in FIG. 3.

The idea about the user preference control 52 is, that the user can operate this user control (step 150) when he is particularly content with the way he perceives sound, i.e. with the current parameter settings (in the current acoustic environment he is in). From the parameter settings currently used at that moment (cf. storage unit 31) and, if acoustic environment analysis is enabled, from the data characterizing that particular current acoustic environment (e.g., the class similarity factors), valuable insight can be gained in how the start-up parameter settings should be changed in order to better suit the user's hearing preferences.

Accordingly, new and improved start-up parameter settings can be derived (step 160) in dependence of

- the current parameter settings (which is equivalent to the user's adjustments of these),
- the class similarity factors,
- the (original) start-up parameter settings.

This three-fold dependency is indicated be the upper three arrows in the left portion of FIG. 3.

The so-obtained new start-up parameter settings are not immediately used in signal processing unit 30 (and storage unit 31). Before that, the hearing system 1 (or at least signal processing unit 30) is shut down (step 170) and is started up again (step 180). Only upon a new start-up (typically the next start-up), the former start-up parameter settings are replaced (step 190) by the new start-up parameter settings derived in step 160; confer also the lower arrow in the left portion of FIG. 3, which shall illustrate that in step 190, i.e. after a start-up, the new start-up parameter settings as derived in step 160 are actually used for controlling signal processing.

Thereafter, further adjustments, user preference control operatings and determinations of again new start-up parameter settings may take place again (not explicitely shown in FIG. 3).

Note that operating the user preference control 52 causes no change to the currently used parameter settings in storage unit 31.

With respect to the point in time at which step 160 will be carried out, there are various possibilities. It is possible, as suggested by FIG. 3, to determine the new set of start-up parameter settings (step 160) (more or less immediately) upon the user's operation of the user preference control 52 (step 150). It is also possible to store—besides the former start-up parameter settings which are in storage unit 90—for each operating of the user preference control 52 until the next shutdown the data characterizing the current acoustic environment, such as the class similarity factors, and the currently used parameter settings (as adjusted by the user), both at the time of the operating of the user preference control. This allows to carry out step 160 at a later point in time. And it also allows to do additional processing on the stored data before or when carrying out step 160. Such a later point in time can be just before a shutdown: E.g., when the user switches off his hearing device 11 or hearing system 1, step 160 will be carried out just before the actual shut-down takes place. Another possibility would be to carry out step 160 upon start-up, i.e. between steps 100 and 110. Of course, other points in time are possible, too.

There are many ways to obtain the new start-up parameter settings, i.e. to carry out step 160. It is possible to incorporate a learning aspect and ensure a rather stable development of the start-up parameter settings by letting the start-up parameter settings develop towards parameter settings in accordance with currently used parameter settings (as adjusted by the hearing system user) in a gradual manner. E.g., when a certain parameter has a start-up value of P and has a current value of V at step 150, the new start-up value P' of that parameter could be, in a simple example, derived as $$P'=(1-\alpha)\cdot P+\alpha\cdot V$$

with $0<\alpha<1$, wherein $\alpha$ determines how strongly new start-up settings will deviate from the old start-up settings: an $\alpha$ near zero will result in only little deviation, whereas an $\alpha$ close to one will provide a "fast" development towards current parameter settings used while operating the user preference control 52. The latter will usually not be desired, because erratic or chaotic developments might occur, whereas values such as $0.1\leq\alpha\leq0.6$ would generally be preferred. Of course, more elaborate schemes and functions are thinkable.

With respect to the data characterizing the current acoustic environment such as the similarity values described above, there are also various possibilities to consider these in deriving new start-up parameter settings (step 160). For example—adhering to the classification example above—one could change settings solely in that one subset of start-up parameter settings, which is associated with that one class, which has the highest similarity value. Or, one could change settings generally in each of the subsets of start-up parameter settings, but to an extent which depends on the respective similarity value, be it linearly, squared or in another way. For example, one could change settings solely in such subsets of start-up parameter settings, which are associated with a class similarity factor that is larger than a prescribable threshold value.

As has been indicated above, the analysis/classification of the current acoustic environment (step 120) is in principle optional, but it is preferred, since it is very advantageous because will usually result in generally improved hearing experience for the user when in varying acoustic environments.

Figure 2:
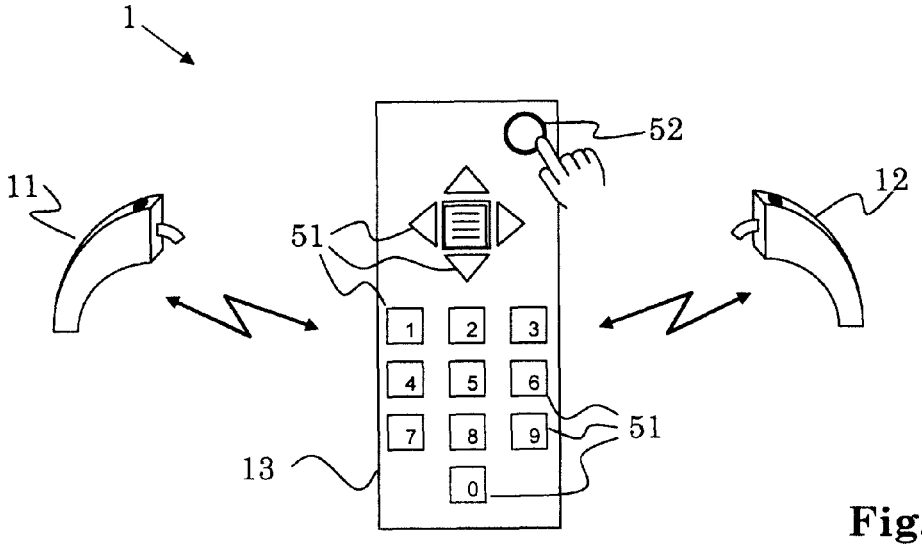
FIG. 2 an illustration of a hearing system with a user preference control.

FIG. 2 is an illustration of a hearing system 1 comprising two hearing devices 11,12 and a remote control 13, which are operationally interconnected via wireless communication links. The remote control comprises several user controls by means of which audio processing parameters can be adjusted (some of them are labelled 51), and a user preference control 52 for the purpose stated above. This hearing system 1 can be designed and can function just like the hearing system depicted in FIG. 1. It is possible to provide a user preference control 52 at one hearing device 11,12 or at both hearing devices 11,12 instead of or additionally to the user preference control 52 at the remote control 13.

Aspects of the embodiments have been described in terms of functional units. As is readily understood, these functional units may be realized in virtually any number of hardware and/or software components adapted to performing the specified functions. For example, control unit 60 and/or analyzing unit 70 may be comprised in a signal processor embodying signal processing unit 30, and storage unit 31 may be comprised in or separate from signal processing unit 30. Referring to FIG. 2: Whether each of the hearing devices 11,12 comprises one issue of each of the constituents of the hearing system 1 depicted in FIG. 1 (maybe with the exception of the user controls 51, 52), or whether such constituents of the hearing devices 11 and 12 are interpreted as forming a portion (a sub-unit) each of such a constituent, is not of particular importance for the invention as described above.

The invention allows a user of a hearing system 1 to adjust the audio signal processing properties of his hearing system 1 to his preferences. It is in particular possible for the user to achieve that his hearing system is particularly well adapted to those acoustic environments to which the user is exposed in reality. This applies in particular for the cases in which acoustic environment analysis is carried out. One has to keep in mind that it is hardly possible to properly simulate in the office of a hearing device professional those acoustic environments to which the user is exposed in reality.

Typically, a hearing system is provided by the hearing system manufacturer with a first set of start-up parameter settings. Typically, these start-up parameter settings are then, at the time of fitting at the hearing device professional's office, adjusted by the hearing device professional such as an audiologist to the preferences of the (new) user of the hearing system. By means of the invention, it is possible for the hearing system user himself to adapt the start-up parameter settings of his hearing system and therewith the way audio signals are processed in his hearing system to his preferences, be it starting from the manufacturer-implemented or with the hearing device professional-adjusted first set of start-up parameter settings. This can lead to a decreased need to visit a hearing device professional and to an improved fitting result. And it is possible that a good fitting result is achieved within a relatively short time.

LIST OF REFERENCE SYMBOLS

1 hearing system
11 device, hearing device
12 device, hearing device
13 device, remote control
20 input unit, input transducer unit, acoustic-to-electric conversion unit, microphone arrangement
30 signal processing unit, signal processor, digital signal processor
31 storage unit, memory containing current parameter settings
40 output unit, electric-to-mechanical conversion unit, loudspeaker
50 user interface
51 user control
52 user control, user preference control
60 control unit
70 analyzing unit, classifying unit
80 storage unit, memory containing data characterizing a current acoustic environment, set of similarity values
90 storage unit, memory containing start-up parameter settings
100-190 steps

What is claimed is:

1. A method for operating a hearing aid device comprising a signal processing unit controllable by adjustable parameters, a user control for adjusting the parameter settings of the signal processing unit to preferences of a user of the hearing aid device, and a user control referred to below as a user preference control for allowing the user to indicate to the hearing aid device that the user is content with parameter settings currently used, said method comprising the steps of a) providing a first set of start-up parameter settings upon start-up of said signal processor unit;

b) using parameter settings comprised in or derived from said first set of start-up parameter settings as default parameter settings for said signal processing unit;

c) using input received from the user via the user control to make adjustments to the default parameter settings; and upon operating said user preference control:

d) obtaining a set of parameter settings currently used in said signal processing unit, said set of parameter settings currently used correspond to the default parameter settings changed by adjustments, carried out by the user via operation of the user control, to a plurality of individual parameters while the user perceives sound in a current acoustic environment in which the user is located;

e) deriving a second set of start-up parameter settings in dependence of said first set of start-up parameter settings and of said set of currently used parameter settings obtained in step d); and f) using said second set of start-up parameter settings as said first set of start-up parameter settings when carrying out step a) upon a following start-up of said signal processor unit, wherein at least one of said second set of start-up parameter settings is not used as said first set of start-up parameter settings before another start-up of said signal processor unit occurred; and in step b), said parameter settings comprised in or derived from said first set of start-up parameter settings are used as default parameter settings for said signal processing unit until the next shut-down of said signal processor unit.

2. The method according to claim 1, wherein the parameters for which said set of parameter settings mentioned in step d) are obtained are adjustable by a user of said hearing aid device.

3. The method according to claim 1, wherein step e) is carried out in such a way that a gradual evolvement of said second set of start-up parameter settings from said first set of start-up parameter settings towards parameter settings in accordance with said currently used parameter settings occurs.

4. The method according to claim 1, comprising the step of c) deriving data characterizing a current acoustic environment;

wherein said deriving said second set of start-up parameter settings mentioned in step e) is carried out also in dependence of said data derived in step c).

5. The method according to claim 4, wherein step c) comprises deriving a set of N class similarity factors, with $N \geq 2$, wherein each of said class similarity factors is indicative of the similarity of said current acoustic environment with a predetermined acoustic environment described by a respective class of N classes each of which describes a predetermined acoustic environment.

6. The method according to claim 5, wherein each of said first and second sets of start-up parameter settings comprises for each of said N classes a subset of start-up parameter settings associated with the respective class.

7. The method according to claim 6, wherein, in dependence of the class similarity factor associated with a respective class, parameter settings comprised in a subset of said first start-up parameter settings associated with said respective class or parameter settings derived therefrom are used or are not used or are used to a degree depending on the respective class similarity factor as default parameter settings for said signal processing unit.

8. The method according to claim 6, wherein in step e), parameter settings are left unchanged in such subsets of start-up parameter settings of said second set of start-up parameter settings, which are associated with a class for which the respective class similarity factor as determined in step c) does not fulfill a pre-defined criterion.

9. A hearing aid device, comprising:

a signal processing unit controllable by adjustable parameters;

at least one user control for adjusting parameter settings of the signal processing unit to preferences of a user of the hearing system;

a user preference control for allowing the user to indicate to the hearing system that the user is content with parameter settings currently used a storage unit operationally connected to said signal processing unit, comprising a first set of start-up parameter settings; and a control unit operationally connected to said user preference control, to said signal processing unit, to said at least one user control, and to said storage unit;

wherein said control unit is adapted to:

upon start-up of said signal processing unit: implement in said signal processing unit said first set of start-up parameter settings, so that parameter settings comprised in or derived from said first set of start-up parameter settings are used as default parameter settings for signal processing in said signal processing unit;

upon operation of said at least one user control by the user: make adjustments to the default parameter settings; and upon operations of said user preference control by the user:

obtain a set of parameter settings currently used in said signal processing unit, said set of parameter settings currently used correspond to the default parameter settings changed by adjustments, carried out by the user via the at least one user control, to a plurality of individual parameters while the user perceives sound in a current acoustic environment in which the user is located;

derive a second set of start-up parameter settings in dependence of said first set of start-up parameter settings and of said obtained set of currently used parameter settings; and replace in said storage unit said first set of start-up parameter settings by said second set of start-up parameter settings, such that at least one of said second set of start-up parameter settings is not used as said first set of start-up parameter settings before another start-up of said signal processor unit occurred; and in step b), said parameter settings comprised in or derived from said first set of start-up parameter settings are used as default parameter settings for said signal processing unit until the next shut-down of said signal processor unit.

10. The hearing aid device according to claim 9, comprising an analyzing unit for deriving data characterizing a current acoustic environment, wherein said deriving said second set of start-up parameter settings is carried out also in dependence of said data.

11. The hearing aid device according to claim 10, wherein said analyzing unit is adapted to deriving a set of N class similarity factors, with N≥2, wherein each of said class similarity factors is indicative of the similarity of said current acoustic environment with a predetermined acoustic environment described by a respective class of N classes each of which describes a predetermined acoustic environment.

12. The hearing aid device according to claim 11, wherein each of said first and second sets of start-up parameter settings comprises for each of said N classes a subset of start-up parameter settings associated with the respective class.

13. The hearing aid device according to claim 12, wherein said control unit is adapted to providing that, in dependence of the class similarity factor associated with a respective class, parameter settings comprised in a subset of said first start-up parameter settings associated with said respective class or parameter settings derived therefrom are used or are not used or are used to a degree depending on the respective class similarity factor as default parameter settings for said signal processing unit.

14. The hearing aid device according to claim 12, wherein said control unit is adapted to providing that, in said deriving said second set of start-up parameter settings, parameter settings are left unchanged in such subsets of start-up parameter settings of said second set of start-up parameter settings, which are associated with a class for which the respective class similarity factor does not fulfill a pre-defined criterion.

15. A non-transitory computer-readable storage medium having stored thereon a computer program product comprising program code for causing a computer to perform the steps of:

A) providing a first set of start-up parameter settings upon start-up of a signal processor unit of a hearing aid device;

B) using parameter settings comprised in or derived from said first set of start-up parameter settings as default parameter settings for said signal processing unit;

C) receiving input from a user control of said hearing aid device and making adjustments to the default parameters settings in accordance with said input;

G) receiving a user input from a user preference control of said hearing aid device;

upon step G):

D) obtaining a set of parameter settings currently used in said signal processing unit, said set of parameter settings currently used correspond to the default parameter settings changed by adjustments, carried out by the user via operation of the user control, to a plurality of individual parameters while the user perceives sound in a current acoustic environment in which the user is located;

E) deriving a second set of start-up parameter settings in dependence of said first set of start-up parameter settings and of said set of currently used parameter settings obtained in step D);

F) using said second set of start-up parameter settings as said first set of start-up parameter settings when carrying out step A) upon a following start-up of said signal processor unit, such that at least one of said second set of start-up parameter settings is not used as said first set of start-up parameter settings before another start-up of said signal processor unit occurred; and in step b), said parameter settings comprised in or derived from said first set of start-up parameter settings are used as default parameter settings for said signal processing unit until the next shut-down of said signal processor unit.

* * * * *

UNITED STATES PATENT AND TRADEMARK OFFICE

CERTIFICATE OF CORRECTION

PATENT NO. : 8,611,569 B2
APPLICATION NO. : 12/679505
DATED : December 17, 2013
INVENTOR(S) : Cornelisse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 421 days.

Signed and Sealed this
Twenty-second Day of September, 2015

Michelle K. Lee

Michelle K. Lee
*Director of the United States Patent and Trademark Office*